US008403451B2

(12) United States Patent
Murahashi

(10) Patent No.: US 8,403,451 B2
(45) Date of Patent: Mar. 26, 2013

(54) CLEANING APPARATUS AND PRINTING APPARATUS

(75) Inventor: Kenichi Murahashi, Fukuoka (JP)

(73) Assignee: Seiko Epson Corporation, Tokyo (JP)

( * ) Notice: Subject to any disclaimer, the term of this patent is extended or adjusted under 35 U.S.C. 154(b) by 754 days.

(21) Appl. No.: 12/572,819

(22) Filed: Oct. 2, 2009

(65) Prior Publication Data

US 2010/0123753 A1 May 20, 2010

(30) Foreign Application Priority Data

Nov. 19, 2008 (JP) ..... 2008-295681

(51) Int. Cl.
*B41J 29/393* (2006.01)

(52) U.S. Cl. ..... 347/19; 358/504

(58) Field of Classification Search ..... 347/19; 358/502, 504

See application file for complete search history.

(56) References Cited

U.S. PATENT DOCUMENTS

| | | | | |
|---|---|---|---|---|
| 4,977,459 | A * | 12/1990 | Ebinuma et al. | 358/296 |
| 7,856,289 | B2 * | 12/2010 | Schanin et al. | 700/236 |
| 2001/0028371 | A1 * | 10/2001 | Su et al. | 347/19 |
| 2002/0196304 | A1 * | 12/2002 | Gomez et al. | 347/23 |
| 2005/0178135 | A1 * | 8/2005 | Schanin et al. | 62/228.1 |
| 2007/0076272 | A1 * | 4/2007 | Miyabayashi et al. | 358/502 |
| 2008/0109109 | A1 * | 5/2008 | Schanin et al. | 700/231 |

FOREIGN PATENT DOCUMENTS

| | | | |
|---|---|---|---|
| JP | 2007-98706 | A | 4/2007 |
| JP | 2008-68438 | A | 3/2008 |

* cited by examiner

*Primary Examiner* — Charlie Peng
*Assistant Examiner* — Peter Radkowski
(74) *Attorney, Agent, or Firm* — Global IP Counselors, LLP

(57) ABSTRACT

A cleaning apparatus, which cleans a print head of a printing apparatus in response to a start trigger for regular cleaning, includes a sound sensor that detects a sound of the operational environment of the printing apparatus, a determination unit that determines whether the operational environment is quiet or not based on a comparison result between detected sound of the sound sensor and a threshold value, and a controller that delays the start of the regular cleaning by holding the start trigger until the operational environment becomes quiet based on a determination result of the determination unit when the start trigger for the regular cleaning has occurred.

5 Claims, 6 Drawing Sheets

CLEANING APPARATUS AND PRINTING APPARATUS

CROSS-REFERENCE TO RELATED APPLICATIONS

This application claims priority to Japanese Application No. 2008-295681 filed on Nov. 19, 2008. The entire disclosure of Japanese Application No. 2008-295681 is incorporated herein by reference.

BACKGROUND

1. Technical Field

The present invention relates to a cleaning apparatus that cleans a print head of a printing apparatus, which performs printing by ejecting ink, and the printing apparatus, and more particularly, relates to control of a start timing of regular cleaning which is carried out automatically in the printing apparatus.

2. Related Art

According to the related art, ink jet printers have been used as receipt printers of a POS system for convenience stores or the like.

The ink jet printer performs predetermined printing by ejecting ink of an ink cartridge from a print head to receipt paper or the like. According to such an ink jet printer, in order to prevent the viscosity of ink remaining in nozzles of the print head from being increased and to prevent bubbles from penetrating into the inside of the print head from the nozzles, regular cleaning is automatically performed to clean the print head by absorbing the ink from the nozzles of the print head, so that printing is always performed in a proper state.

Further, since a nozzle formation surface of the print head faces the paper while being spaced apart from the paper at a predetermined interval, paper dust, ink or the like may be easily attached to the nozzle formation surface. If the paper dust, ink or the like are attached to the nozzle formation surface, holes of the nozzles may be clogged or the paper may be contaminated due to the ink attached thereto. In order to solve these problems, the regular cleaning is performed to wipe impurities attached to the nozzle formation surface by using an elastic absorption plate, so that a printing operation can be always performed in a proper state.

In general, the regular cleaning is automatically performed after a predetermined time lapses from the previous cleaning. Thus, in a receipt printer employing the ink jet printer, a start timing of the regular cleaning may be reached while a receipt to be provided to a product purchaser is being printed. In such a case, cleaning must be performed after the printing process is primarily performed, or the printing process must be temporarily stopped so that the cleaning can be primarily performed. However, if the cleaning is primarily performed and thus the purchaser has to wait for a predetermined time until the cleaning is completed, the reputation of the convenience store may be adversely affected in terms of service quality. In contrast, if the printing process is primarily performed so that the regular cleaning is delayed, since cleaning is not performed for a long time, the print quality of the receipt or the like may be degraded.

Further, the start timing of the regular cleaning may be reached during the printing process in an ink jet printer serving as an image recording apparatus in which continuous printing is performed, as well as an ink jet printer used in an office and a household (see paragraphs 0002 to 0014 and 0033 to 0072, and FIGS. 4A to 7 of JP-A-2008-68438).

According to patent document 1, in the ink jet printer serving as the image recording apparatus, if the start timing of the regular cleaning for the print head is reached during the printing process, the printing process is temporarily stopped at a proper timing in consideration of the remaining number of papers to be printed and then the cleaning is performed, so that the workability is improved and the print quality is prevented from being degraded. However, in such a case, the printing process is essentially stopped.

In this regard, there has been proposed a scheme for calculating a low print time zone, in which the printing quantity is equal to or less than a predetermined value, from the previous history of a printing operation in such a printing apparatus which uses the ink jet printer such as the receipt printer, and regular cleaning is performed in the low print time zone, so that the regular cleaning is performed at a proper timing corresponding to the operational environment of the printing apparatus while preventing the printing process from overlapping the regular cleaning (see paragraphs 0013 to 0015 and 0042 to 0064, and FIGS. 4 to 10 of JP-A-2007-98706).

However, although the regular cleaning is performed in the low print time zone calculated based on the previous history as disclosed in JP-A-2007-98706, a printing process for printing a receipt or the like may be necessarily performed in the low print time zone under an operational environment in which the printing process for printing the receipt or the like happens irregularly in a convenience store or the like. At this time, if the regular cleaning is performed, the purchaser or the like must wait until the cleaning is completed. Further, in the printing apparatus of a convenience store open 24 hours a day under the operational environment in which the printing process for printing the receipt or the like happens irregularly through the day, the above problem must be solved.

SUMMARY

An advantage of some aspects of the invention is that it starts regular cleaning at an optimal timing, at which no wait time of a printing process occurs, under the operational environment as described above.

According to an aspect of the invention, there is provided a cleaning apparatus that cleans a print head of a printing apparatus, which performs printing by ejecting ink, in response to a start trigger for regular cleaning, the cleaning apparatus including a sound sensor that detects a sound of the operational environment of the printing apparatus, a determination unit that determines whether the operational environment is quiet or not based on a comparison result between detected sound of the sound sensor and a threshold value, and a controller that delays the start of the regular cleaning by holding the start trigger until the operational environment becomes quiet based on a determination result of the determination unit when the start trigger for the regular cleaning has occurred.

In such a case, while the printing apparatus is printing a receipt or the like, the level of the sound (noise) of the operational environment of the printing apparatus is increased due to the printing sound of the printing apparatus or the sound of the motion or voice of a purchaser waiting to pay the purchase price. When the start trigger for the regular cleaning has occurred, the level of the sound of the operational environment of the printing apparatus, which is detected by the sound sensor, is increased due to the printing sound of the receipt or the like or sound generated from the purchaser waiting to pay the purchase price. If the operational environment of the printing apparatus is not quiet, the controller can delay the start of the regular cleaning by holding the start trigger until the operational environment becomes quiet based on the determination result of the determination unit on the basis of a result obtained by comparing the detected sound of the sound sensor with the threshold value. Thus, the regular cleaning can be performed when no printing of the receipt or the like is actually performed and no purchaser waiting to pay the purchase price is present, regardless of time zone or the like. Under various operational environments, the regular cleaning can be performed at an optimal timing at which no wait time of a printing process occurs.

Further, the determination unit of the cleaning apparatus of the invention stores the threshold value, which is set between a minimum value of the sound of the operational environment up to just before printing until a printing mechanism operates to perform the printing after a print job is started in the printing apparatus, and a minimum value of the sound of the operational environment through the day, and determines whether the operational environment is quiet or not by comparing the detected sound of the sound sensor with the threshold value in response to the start trigger.

In such a case, if the threshold value is larger than the minimum value of the sound of the motion or voice of a purchaser waiting to pay the purchase price except for the sound (i.e., printing sound) of the operational environment up to just before printing until the printing mechanism operates after the print job is started, the regular cleaning may overlap the printing process of the receipt or the like, which is provided to a customer waiting to pay the purchase price. Further, if the threshold value is set to be equal to or less than the minimum value of the sound of the operational environment through the day, although the operational environment becomes quiet, the regular cleaning may not be performed. However, the threshold value is set between the levels of such sounds and the detected sound of the sound sensor is compared with the threshold value, so that the above problems can be prevented from occurring and it is possible to exactly determine whether the operational environment is quiet. Further, it is possible to provide a detailed configuration in which the optimal timing at which no wait time of the printing process occurs can be estimated and then the regular cleaning can be performed.

Further, the threshold value is preferably updated through a learning process based on repeated determination for the minimum value of the sound of the operational environment during a period up to just before the printing, and the minimum value of the sound of the operational environment through the day.

In such a case, the threshold value is updated to the optimal value through the learning process based on the change in the sound of the operational environment, and the regular cleaning can be performed at the optimal timing at which no wait time of the printing process occurs.

Further, the printing apparatus includes a receipt printer which is connected to a host computer of a POS system.

The printing apparatus of the invention is provided with the cleaning apparatus having the configuration as described above can estimate the optimal timing at which no wait time of the printing process occurs and then can perform the regular cleaning under various operational environments.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, one embodiment of the invention will be described with reference to FIGS. 1 to 7.

Entire Configuration

Figure 1:
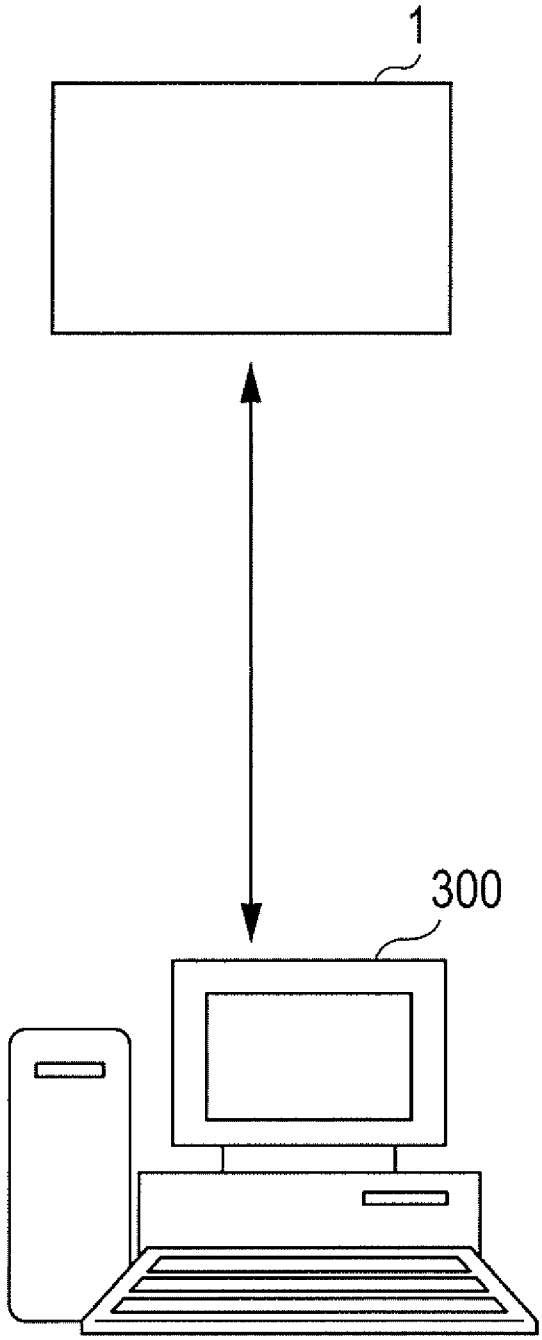
FIG. 1 is a view showing a POS system according to one embodiment of the invention.

FIG. 1 is a view schematically showing the configuration of a POS system according to the embodiment of the invention. For example, the POS system includes a host computer 300, which is installed in the inside of a convenience store open 24 hours a day or an office out of the convenience store, and an ink jet printer 1 which is installed at a counter in the convenience store while being connected to the convenience store in a wired or wireless manner and which serves as a receipt printer. The ink jet printer 1 is always in a state capable of printing except for an exceptional period such as regular cleaning to be described later. If print data based on reading of barcodes of products is received from the host computer 300, the ink jet printer 1 prints receipts or coupons on an irregular basis. Then, the printed receipts or coupons are given to a purchaser, who has paid the purchase price, through a clerk or a worker.

Figure 2:
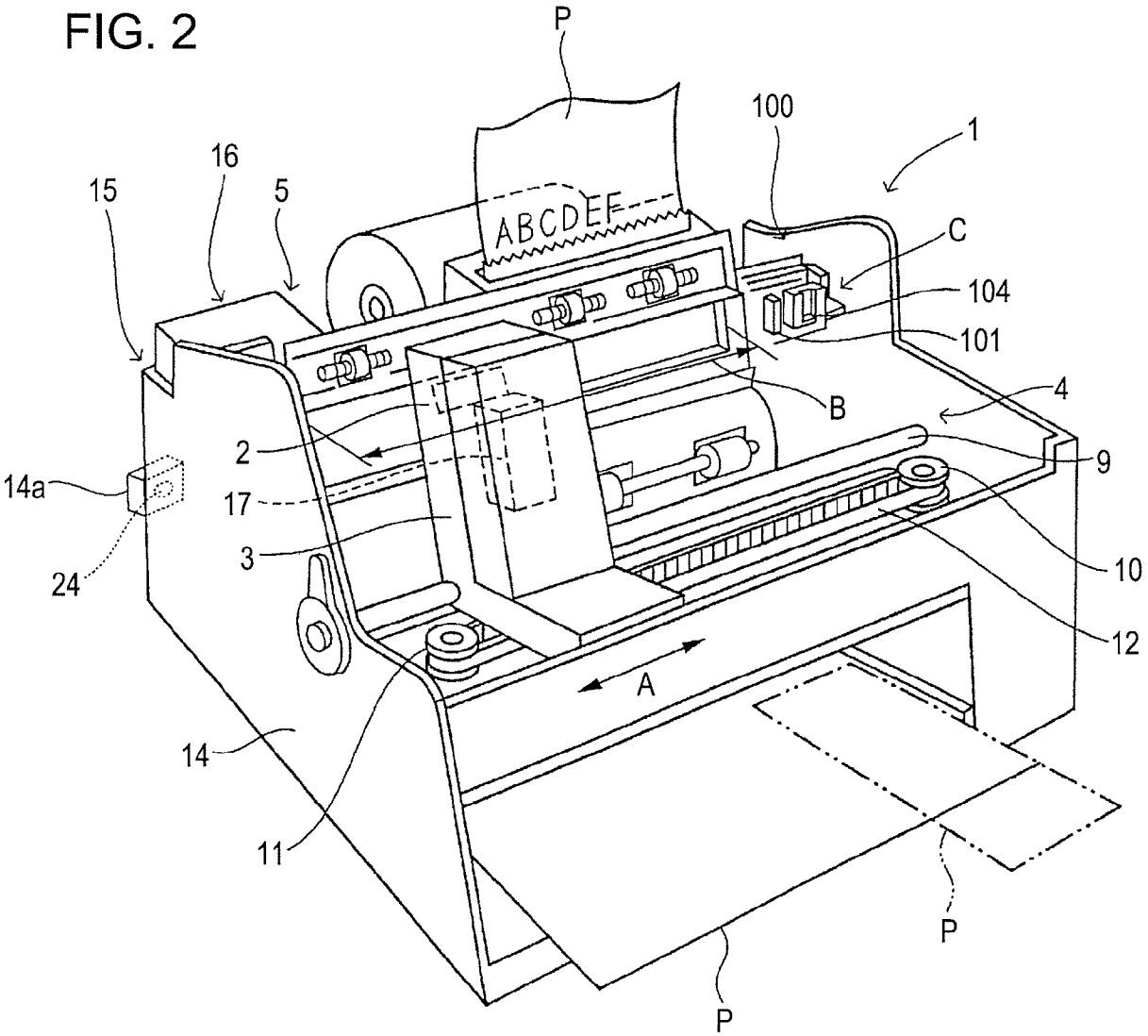
FIG. 2 is a perspective view showing an ink jet printer shown in FIG. 1.
Figure 3:
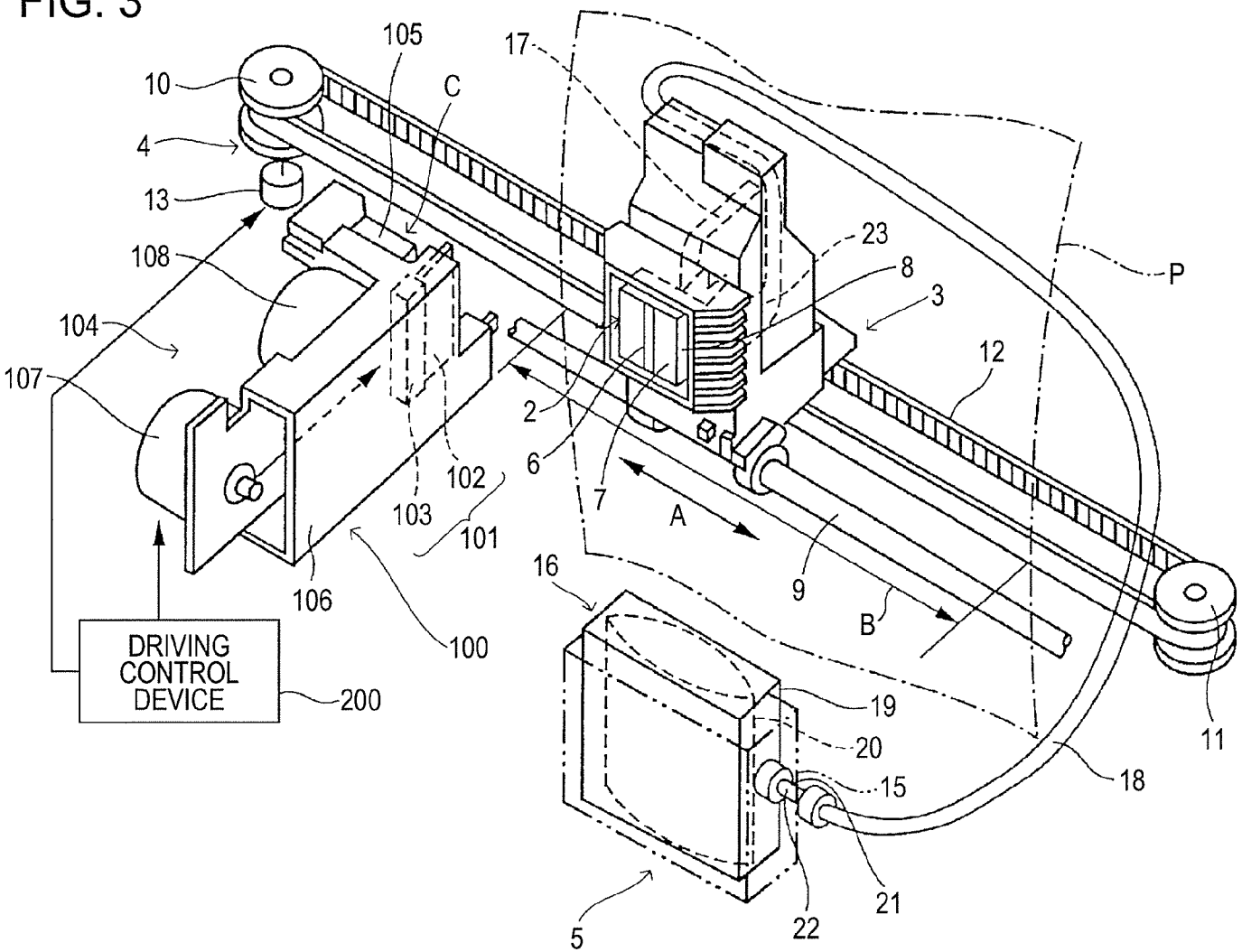
FIG. 3 is a perspective view showing the main elements of an ink jet printer shown in FIG. 1.

The ink jet printer 1 serving as the printing apparatus of the invention is provided with the cleaning apparatus of the invention, which will be described later. FIG. 2 is a front perspective view showing the ink jet printer 1. FIG. 3 is a rear perspective view showing the main parts in a body 14 of the ink jet printer 1.

As shown in FIGS. 2 and 3, the ink jet printer 1 includes a print head 2 for ejecting ink, a carriage 3 provided with the print head 2, a transfer mechanism 4 for transferring the carriage 3 in the scanning direction indicated by an arrow A of FIG. 2, and an ink supply mechanism 5 for supplying ink to the print head 2. Further, the body 14 of the ink jet printer 1 is provided at a proper position of the rear surface (see FIG. 1) or the side surface thereof with a container 14*a* of a sound sensor 24 that detects sound of the operational environment in the convenience store. The sound sensor 24 detects sound (noise) in the convenience store, and may include a small-sized microphone having a simple configuration. However, the sound sensor 24 may have various configurations.

As shown in FIGS. 2 and 3, the print head 2 includes a nozzle formation surface 7 having a rectangular shape, which is provided with a plurality of nozzles 6 that eject ink. The nozzle formation surface 7 is exposed through a rectangular opening 8 which is formed in the carriage 3. The transfer mechanism 4 transferring the carriage 3 from side to side includes a guide shaft 9, a timing belt 12 installed between a driving pulley 10 and a driven pulley 11, and a carriage motor 13 that rotates the driving pulley 10. The lower surface of the carriage 3 is supported by the guide shaft 9 to slidably move along the guide shaft 9, and is connected to the timing belt 12.

Thus, if the timing belt 12 is rotated by the carriage motor 13, the carriage 3 moves along the guide shaft 9 in the scanning direction A shown in FIG. 2.

While the carriage 3 is moving in the scanning direction A as described above and a paper P wound in a roll form is being transported, the ink supplied from the ink supply mechanism 5 is ejected toward the paper P from the nozzles 6 of the print head 2, so that printing is performed. That is, the paper P is transported at the position facing the nozzle formation surface 7 and an amount of money or the like is printed on the surface of the paper P by the ejected ink droplets. The ink supply mechanism 5 includes an ink cartridge 16, which is detachably installed at an ink cartridge installation unit 15 provided in the body 14 of the ink jet printer 1, a pressure attenuator 17 installed in the carriage 3, and an ink supply pipe 18 that connects the ink cartridge 16 to the pressure attenuator 17.

The ink cartridge 16 includes a hard case 19 and a flexible ink receiving section 20 received in the hard case 19. An ink supply injector 22 installed at one end of the ink supply pipe 18 is connected to an ink discharge port 21 formed in the ink receiving section 20. The pressure attenuator 17 is connected to the other end 23 of the ink supply pipe 18. Thus, ink stored in the ink receiving section 20 of the ink cartridge 16 is supplied to the pressure attenuator 17 through the ink supply pipe 18, and is then supplied to the print head 2. Consequently, the ink supplied to the print head 2 is ejected from the nozzles 6.

A cleaning unit 100 (a mechanism unit of the cleaning apparatus of the invention) is installed at the position facing a home position of the carriage 3, which is indicated by an arrow C of FIG. 3. The cleaning unit 100 is prepared in the form of an ink recovery mechanism for cleaning the print head 2 and includes a head wiping mechanism 101 and an ink absorbing mechanism 104.

Ink Absorbing Mechanism

The ink absorbing mechanism 104 includes a cap 105 that covers the nozzle formation surface 7 of the print head 2 when the print head 2 has moved to the home position C. The cap 105 is withdrawn to a side of a unit case 106 while the carriage 3 is passing through a recording area B. Then, if the carriage 3 moves into the home position C, the cap 105 protrudes forward from the unit case 106 to cover the nozzle formation surface 7 of the print head 2.

Inner pressure of the cap 105 is reduced by a pump 108 which is driven by a motor 107 installed in the unit case 106. Thus, the pump 108 is driven in a state in which the cap 105 covers the nozzle formation surface 7, so that an ink absorbing process (cleaning) can be performed to absorb the ink from the nozzles 6 and discharge the ink. As a result of the ink absorbing process, bubbles in the print head 2 or ink having high viscosity can be removed, so that the ink in the print head 2 can be returned to a proper state.

Head Wiping Mechanism

As shown in FIG. 2, the head wiping mechanism 101 includes an elastically transformable blade 102 and a blade support member 103 that supports the blade 102. The blade support member 103 be moved by the motor 107, which is installed in the unit case 106, through a transfer mechanism (not shown) such as a gear train, which is installed in the unit case 106. Further, the blade support member 103 is withdrawn in the unit case 106 and protrudes from the unit case 106. If the blade 102 protrudes from the unit case 106, a front end of the blade 102 makes contact with the nozzle formation surface 7 to wipe ink or paper dust attached to the nozzle formation surface 7 when the carriage 3 has moved into the home position C from the print area B.

Driving Control System

The print operation of the print head 2, the operation of a transport mechanism (not shown) of the paper P, and the operation of the ink absorbing mechanism 104 and the head wiping mechanism 101 or the like in the ink jet printer 1 are controlled by a driving control apparatus 200 which forms a circuit unit of the cleaning apparatus of the invention and includes a microcomputer as a main element.

That is, the driving control apparatus 200 controls the driving of each element of the ink jet printer 1 by using working areas of a RAM (not shown) based on control program stored in advance in a ROM (not shown).

Figure 4:
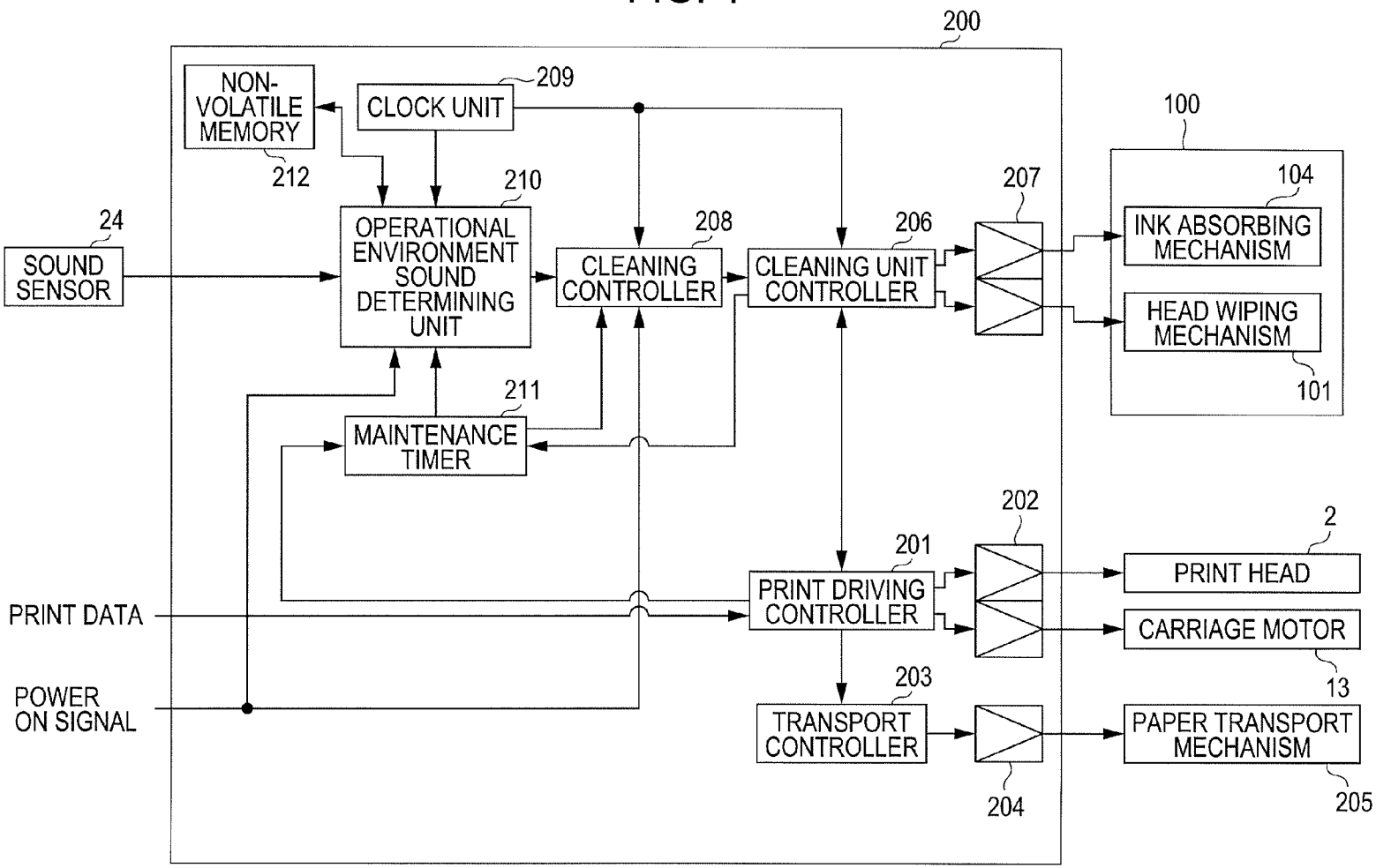
FIG. 4 is a block diagram showing functions of an ink jet printer shown in FIG. 1.

FIG. 4 is a block diagram showing the function of the driving control system. The driving control system has a print control function, a transport control function, and start and driving control functions of the cleaning unit 100 that cleans the print head 2. Unless otherwise noted, the cleaning of the print head 2 in the embodiment includes one of the ink absorbing operation, which is performed by the ink absorbing mechanism 104 with respect to the nozzles 6, and the wiping operation of wiping ink or paper dust attached to the nozzle formation surface 7, which is performed by the head wiping mechanism 101, or includes a process obtained by combining the ink absorbing operation with the wiping operation. The regular cleaning is automatically performed based on a start trigger for cleaning, which is generated every predetermined period.

A print driving controller 201 shown in FIG. 4 controls the driving of the carriage motor 13 and the print head 2 through drivers 202 to perform the desired printing on the paper P. A transport controller 203 controls the driving of a paper transport mechanism 205 such as a transport motor through a driver 204 in cooperation with the printing operation.

A cleaning unit controller 206 shown in FIG. 4 starts an operation in response to a cleaning start trigger (start signal) such as regular cleaning from a cleaning controller 208, thereby controlling the cleaning of the print head 2 through the ink absorbing mechanism 104, which includes an absorbing motor 107 or the like, via a driver 207. When cleaning the print head 2, the cleaning unit controller 206 drives the carriage 3 or the like to move the print head 2 to a predetermined position, and controls driving of the cleansing unit 100 to perform a predetermined ink absorbing operation and head wiping operation.

After a cleaning controller 208 serving as a control device of the invention receives a time signal of a clock unit 209, the start trigger for the regular cleaning of a maintenance timer 211, and a determination result of an operational environment sound determining unit 210, the cleaning controller 208 holds the start trigger for the regular cleaning until the operational environment becomes quiet based on determination information from the operational environment sound determining unit 210 that receives detected sound from the sound sensor 24, and delays output of the start trigger for the regular cleaning to the cleaning unit controller 206 until the operational environment becomes quiet.

Detected sound of Sound Sensor 24

The sound sensor 24 operates while the ink jet printer 1 is turned on, and normally detects the sound of the operational environment of the ink jet printer 1 through the day (for 24 hours), that is, sound in the convenience store. The detected sound includes the printing sound (mechanical operation sound) of the ink jet printer 1, sound generated from a clerk or a purchaser or the like. However, the detected sound mainly includes the sound of a clerk and a purchaser talking, except for the printing sound, up to just before the ink jet printer 1 does not perform printing. In general, with the increase in the number of purchasers who wait to pay the purchase price, the level of the detected sound is increased. Meanwhile, at midnight and early in the morning when no purchaser is present and no printing is performed by the ink jet printer 1, the detected sound is at a minimum level.

Figure 5:
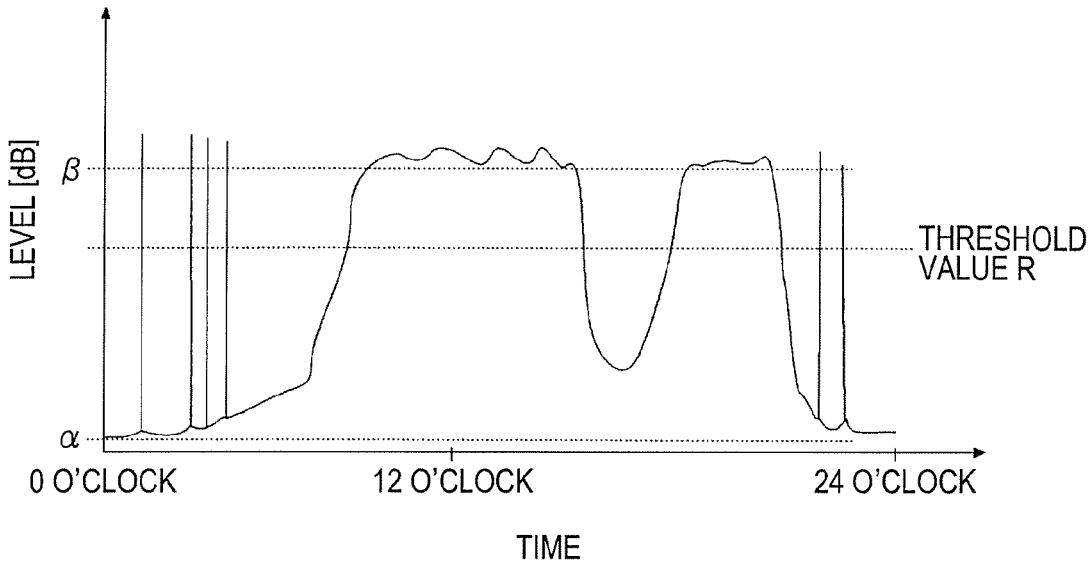
FIG. 5 is a graph showing an example of the change in the level of detected sound of a sound sensor through the day in FIG. 1.

Further, for example, the sound detected by the sound sensor 24 through the day changes as shown in FIG. 5. As it can be seen from FIG. 5, if a purchaser enters the convenience store and the printing sound or talk sound is generated at midnight and early in the morning, the level of the detected sound is increased. In addition, the printing sound of the ink jet printer 1 includes operation sound (mechanical sound) of the printing mechanism when the ink jet printer 1 actually performs printing in response to a print job generated after the ink jet printer 1 receives print data from the host computer 300.

Processing of Operational Environment Sound Determining Unit 210 Setting of Threshold Value Further, since the level of the detected sound of the sound sensor 24 is increased due to the printing sound of the ink jet printer 1 and the sound of the motion or voice of a purchaser waiting to pay the purchase price, the operational environment sound determining unit 210 determines whether the operational environment is quiet or not by comparing the detected sound of the sound sensor 24 with a threshold value (decibel value) of a suitable size, so that the start of the regular cleaning is held based on the comparison result regardless of time zone or the like when the operational environment is not quiet due to printing by the ink jet printer 1 or the purchaser waiting to pay the purchase price. Thus, the ink jet printer 1 completes the printing, so that no purchaser has to wait for completion of the printing. In addition, the start of the regular cleaning can be delayed until the operational environment becomes quiet.

The threshold value, which serves as a reference (i.e., a determination reference for quietness of the operational environment) used to determine whether to hold the start of the regular cleaning, can be set by collecting sound of the operational environment of the ink jet printer 1 through the day. However, at that time, if the threshold value is set to be equal to or less than minimum detected sound a during a day as shown in FIG. 5, when detected sound larger than the minimum detected sound $\alpha$ is obtained, the regular cleaning is not performed. As a result, the regular cleaning may not be completely performed.

Figure 6:
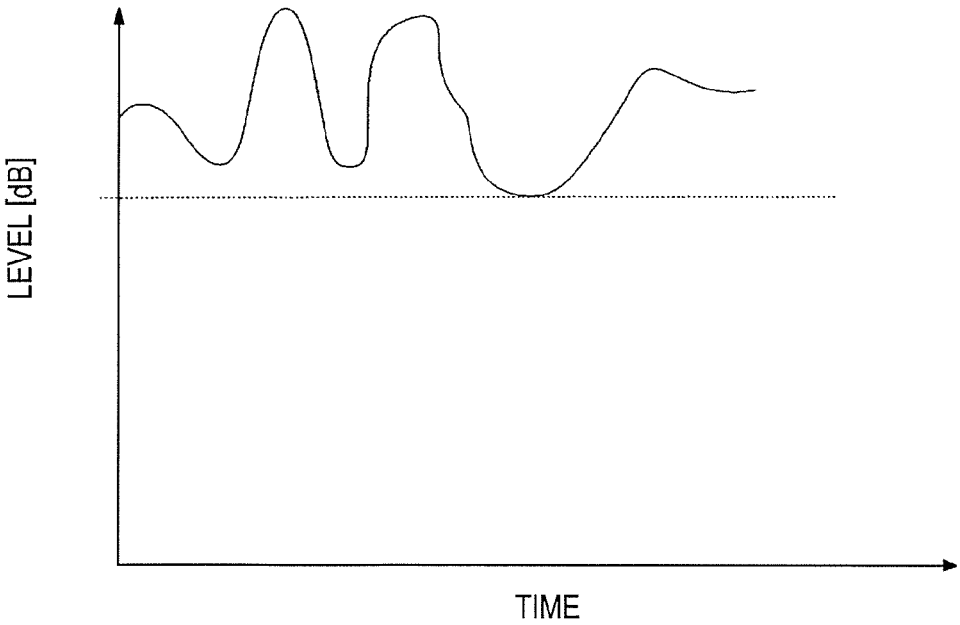
FIG. 6 is a graph showing the change in the level of detected sound of a sound sensor during printing in FIG. 1.

Meanwhile, the presence or absence of a purchaser waiting to pay the purchase price can be determined from a result obtained by determining whether the level of ambient environment sound, except for the printing sound of the ink jet printer 1, is increased due to the sound of the motion or voice of a purchaser waiting to pay the purchase price. Further, since detected sound up to just before a print job is started in the ink jet printer 1 so that printing is performed and thus the printing mechanism operates becomes the latest detected sound such as the sound of the motion or voice of the purchaser waiting to pay the purchase price, the threshold value may be set to be equal to or larger than a minimum value $\beta$ of detected sound during a day as shown in FIG. 5 up to just before the print job is started in the ink jet printer 1 so that the printing is performed and thus the printing mechanism operates. However, in such a case, when the level of environmental noise is reduced due to unknown factors and thus the level of the printing sound detected from the ink jet printer 1 is reduced, the regular cleaning may be performed while the printing is being performed. For example, if a range around 12 o'clock on a time axis shown in FIG. 5 is extended, FIG. 6 is obtained.

In this regard, after the operational environment sound determining unit 210 serving as a determination device of the invention together with a non-volatile memory 212 writes sampling data of small time intervals, which is obtained from detected sound of the sound sensor 24 through the day, in the non-volatile memory 212 together with information such as the print execution time of the ink jet printer 1 such that the sampling data and the information are collected, the operational environment sound determining unit 210 detects the minimum value $\alpha$ of all the detected sounds at a corresponding date as the lowest limit value and the minimum value $\beta$ up to just before printing at the corresponding date as the upper limit value at a predetermined time with reference to the collection result of the previous time (e.g., the other day) through the day, and, for example, calculates a threshold value R of a suitable size between the lowest limit value (minimum value $\alpha$) and the upper limit value (minimum value $\beta$) from a weighted average operation $(A\times\alpha+B\times\beta)/2$. The operational environment sound determining unit 210 then stores the threshold value R in the non-volatile memory 212, such as an EEPROM or a flash memory which permits rewriting, in order to set the suitable threshold value R as a determination reference used when it is determined whether an operational environment is quiet. In this way, the regular cleaning is performed as necessary and can be performed without overlapping a printing process. Further, in the average operation formula, A and B denote weighted coefficients.

The threshold value R may be initially set one time. However, in order to improve reliability or the like, it is preferred to regularly update the threshold value R every day or every month or similar. Further, through the updating, the threshold value R may be completely replaced with the latest threshold value calculated this time. For example, it is preferred to update the threshold value through a learning process in consideration of the previous threshold value R from an operation $(C\times\text{current } R+D\times\text{latest } R)/2$ based on the current threshold value R in the non-volatile memory 212 and the latest threshold value R calculated this time. Further, it is preferred to update the threshold value R at a predetermined time at midnight or early in the morning for which the number of purchasers is small. In the above operation formula, C and D denote weighted coefficients.

Determination Process

On the basis of the threshold value R set as described above, if the start trigger for the regular cleaning is received from the maintenance timer 211, the operational environment sound determining unit 210 repeatedly compares the latest detected sound of the sound sensor 24 with the threshold value R stored in the non-volatile memory 212 until the determination result is changed to a holding-release level to be described later. Then, if the latest detected sound of the sound sensor 24 has a value lower than the threshold value R, the operational environment sound determining unit 210 outputs the determination result, which represents that a hold-maintenance level is changed to the hold-release level, to the cleaning controller 208.

Process of Cleaning Controller 208

Hereinafter, a process by which the cleaning controller 208 controls the regular cleaning will be described with reference to a flow chart shown in FIG. 7.

Figure 7:
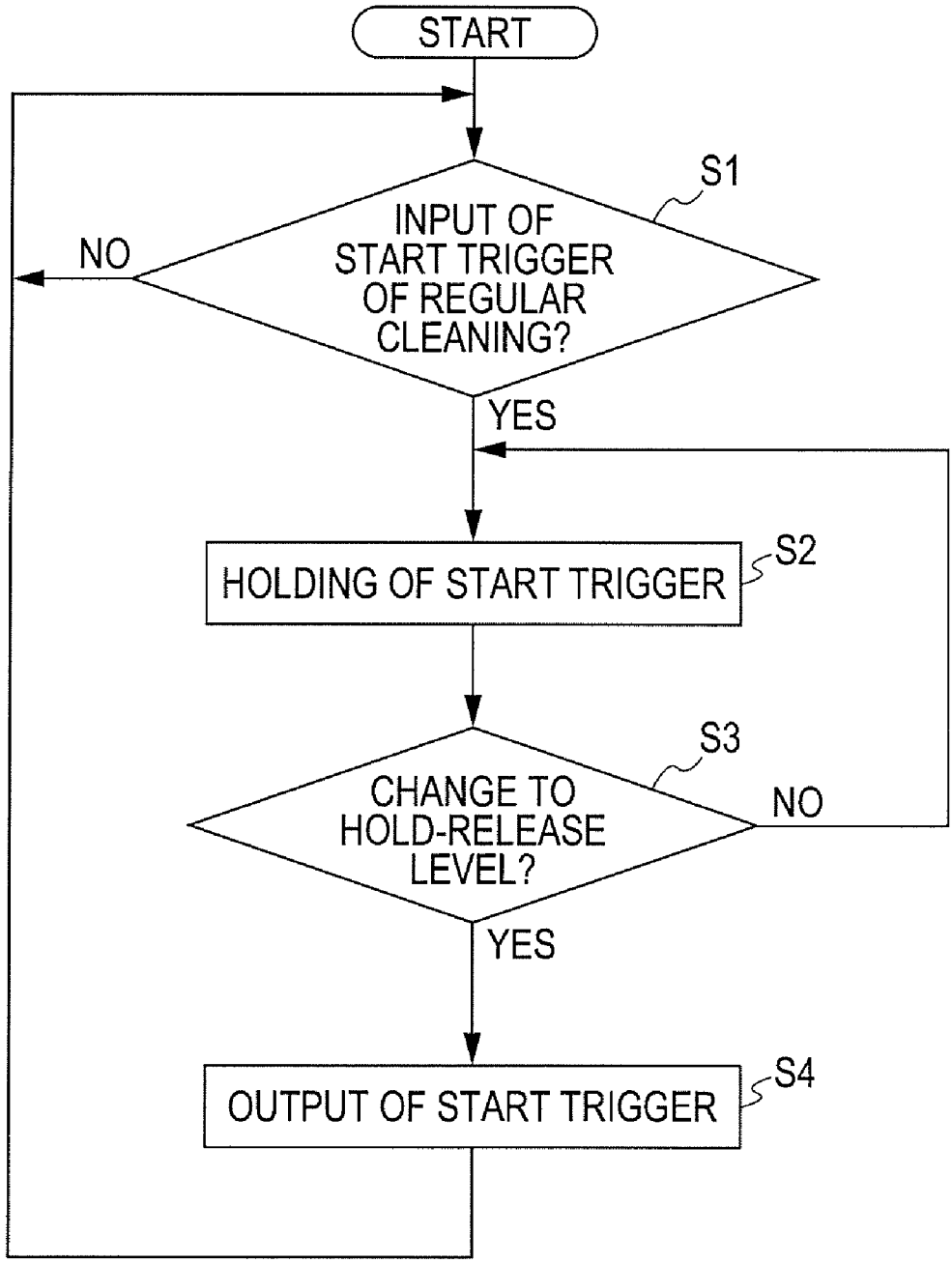
FIG. 7 is a flow chart showing an operation of a cleaning controller shown in FIG. 4.

If the start trigger for the regular cleaning is received from the maintenance timer 211, the cleaning controller 208 stores the trigger in a register or the like to hold the output thereof (Steps S1 and S2 shown in FIG. 7). Then, the cleaning controller 208 waits until the operational environment of the ink jet printer 1 becomes quiet based on the determination result of the operational environment sound determining unit 210, which represents that the hold-maintenance level is changed to the hold-release level (Steps S2 and S3 shown in FIG. 7). When the level of the detected sound of the sound sensor 24 is increased because the ink jet printer 1 prints a receipt or the like or a purchaser waiting to pay the purchase price is present, the cleaning controller 208 does not start the regular cleaning.

Then, if the operational environment of the ink jet printer 1 becomes quiet, or no purchaser waiting to pay the purchase price is present after printing of the ink jet printer 1 is completed, the determination result of the operational environment sound determining unit 210 represents that the hold-maintenance level is changed to the hold-release level, so that the holding of the start trigger for the regular cleaning is released and the start trigger is output to the cleaning unit controller 206 so that the cleaning unit controller 206 is driven (Steps S3 and S4 shown in FIG. 7).

Process of Cleaning Unit Controller 206

The cleaning unit controller 206 driven in response to the start trigger for the regular cleaning controls driving of the cleaning unit 100 through the driver 207 as described above to perform the predetermined ink absorbing operation and head wiping operation with respect to the print head 2, so that the regular cleaning is performed with respect to the print head 2.

Further, the sound sensor 24, the cleaning unit 100, the cleaning unit controller 206, the driver 207, the cleaning controller 208, the clock unit 209, the operational environment sound determining unit 210, the maintenance timer 211 and the non-volatile memory 212 constitute the cleaning apparatus of the print head 2.

According to the embodiment, when the start trigger for the regular cleaning has occurred, if the operational environment (the inside of the convenience store) of the ink jet printer 1 is not quiet because the level of the detected sound of the sound sensor 24 is increased due to the printing sound of a receipt or the sound of the motion or voice of a purchaser waiting to pay the purchase price, the cleaning controller 208 holds the start trigger until the operational environment of the ink jet printer 1 becomes quiet, so that the start of the regular cleaning can be delayed. Thus, the regular cleaning can be performed by exactly estimating an optimal timing, at which no printing of a receipt or the like is actually performed and no purchaser waiting to pay the purchase price is present, regardless of time zone or the like. In particular, in a convenience store open 24 hours a day, the service quality can be prevented from being degraded due to the regular cleaning. Consequently, it is possible to provide a receipt printer serving as an ink jet printer provided with a novel cleaning apparatus.

Further, the invention is not limited to the embodiment as described above. That is, various modifications can be made without departing the scope of the invention. For example, the sound sensor 24 may be provided separately from the body 14 to transmit detected sound data to the driving control apparatus 200 of the body 14 in a wired manner or in a wireless manner. In such a case, the sound sensor 24 may be provided at a position at which sound is easily collected. Further, the setting method and the calculation method of the threshold value R are not limited to those of the embodiment.

In addition, the invention can be applied to an ink jet printer with various purposes and various information management systems and a cleaning apparatus thereof as well as a receipt printer of a POS system and a cleaning apparatus thereof. Moreover, the invention can be applied to various ink jet printers for an office or a household and the cleaning apparatuses thereof.

What is claimed is:

1. A cleaning apparatus that cleans a print head of a printing apparatus, which performs printing by ejecting ink, in response to a start trigger for regular cleaning, the cleaning apparatus comprising:

a sound sensor configured on an outer surface of the printing apparatus to detect a sound of operational environment around the printing apparatus;

a determination unit that determines whether the operational environment is quiet or not based on a comparison result between detected sound of the sound sensor and a threshold value; and a controller that delays start of the regular cleaning by holding the start trigger until the operational environment becomes quiet based on a determination result of the determination unit when the start trigger for the regular cleaning has occurred.

2. The cleaning apparatus according to claim 1, wherein the determination unit stores the threshold value, which is set between a minimum value of the sound of the operational environment up to just before printing until a printing mechanism operates to perform the printing after a print job occurs in the printing apparatus, and a minimum value of the sound of the operational environment through the day, and determines whether the operational environment is quiet or not by comparing the detected sound of the sound sensor with the threshold value in response to the start trigger.

3. The cleaning apparatus according to claim 2, wherein the threshold value is updated through a learning process based on repeated determination of the minimum value of the sound of the operational environment during a period up to just before the printing, and the minimum value of the sound of the operational environment through the day.

4. The cleaning apparatus according to claim 1, wherein the printing apparatus includes a receipt printer which is connected to a host computer of a POS system.

5. A printing apparatus comprising the cleaning apparatus according to claim 1.

* * * * *